US011309152B2

(12) United States Patent
Buzzetti et al.

(10) Patent No.: US 11,309,152 B2
(45) Date of Patent: Apr. 19, 2022

(54) TEMPERATURE-BASED CONTROL OF INDUCTOR DEMAGNETIZATION

(71) Applicant: Maxim Integrated Products, Inc., San Jose, CA (US)

(72) Inventors: Siro Buzzetti, Arese (IT); Marco Demicheli, Binago (IT); Danilo Ranieri, Cislago (IT)

(73) Assignee: Maxim Integrated Products, Inc., San Jose, CA (US)

( * ) Notice: Subject to any disclaimer, the term of this patent is extended or adjusted under 35 U.S.C. 154(b) by 558 days.

(21) Appl. No.: 15/608,071

(22) Filed: May 30, 2017

(65) Prior Publication Data

US 2017/0278659 A1 Sep. 28, 2017

Related U.S. Application Data

(63) Continuation of application No. 14/184,866, filed on Feb. 20, 2014, now Pat. No. 9,673,007.

(60) Provisional application No. 61/880,446, filed on Sep. 20, 2013.

(51) Int. Cl.

| | |
|---|---|
| ***H01F 13/00*** | (2006.01) |
| ***H01H 41/00*** | (2006.01) |
| ***H01H 47/22*** | (2006.01) |

(52) U.S. Cl.

CPC ..... *H01H 47/22* (2013.01); *H01F 13/006* (2013.01)

(58) Field of Classification Search

CPC ..... H01H 47/22; H01F 13/006
USPC ..... 361/149, 93.1
See application file for complete search history.

(56) References Cited

U.S. PATENT DOCUMENTS

| | | | | |
|---|---|---|---|---|
| 5,028,811 | A * | 7/1991 | Le Roux | H03K 17/04123 327/110 |
| 5,115,388 | A | 5/1992 | Shigekane | |
| 5,328,866 | A * | 7/1994 | Chang | H01L 21/32 257/E21.258 |
| 5,508,906 | A * | 4/1996 | Nelli | H02H 9/047 318/434 |
| 5,828,247 | A | 10/1998 | Moller et al. | |
| 6,170,241 | B1 | 1/2001 | Shibilski et al. | |
| 6,624,604 | B2 | 9/2003 | Torikoshi et al. | |
| 6,700,428 | B2 | 3/2004 | Sander | |
| 9,673,007 | B2 | 6/2017 | Buzzetti et al. | |
| 2005/0275025 | A1* | 12/2005 | Lanzerstorfer | H01L 21/8234 257/350 |
| 2006/0125568 | A1* | 6/2006 | Felder | G05F 1/573 330/298 |

(Continued)

FOREIGN PATENT DOCUMENTS

JP 2006352931 A 12/2006

*Primary Examiner* — Jared Fureman
*Assistant Examiner* — Lucy M Thomas

(57) ABSTRACT

An integrated circuit for demagnetizing an inductive load includes a first switch to control current supplied by a voltage supply to the inductive load. A Zener diode includes an anode connected to a control terminal of the first switch and a cathode connected to the voltage supply. A second switch includes a control terminal and first and second terminals. A temperature sensing circuit is configured to sense a temperature of the first switch and to generate a sensed temperature. A comparing circuit includes inputs that receive a reference temperature and the sensed temperature and an output connected to the control terminal of the second switch.

10 Claims, 3 Drawing Sheets

(56) References Cited

U.S. PATENT DOCUMENTS

| | | | | |
|---|---|---|---|---|
| 2007/0216461 | A1* | 9/2007 | Morino | H01L 27/0248 327/287 |
| 2010/0079197 | A1 | 4/2010 | Ladurner et al. | |
| 2010/0079920 | A1 | 4/2010 | Fanic | |
| 2010/0134941 | A1 | 6/2010 | Nakahara | |
| 2010/0315017 | A1 | 12/2010 | Yu et al. | |
| 2012/0153974 | A1 | 6/2012 | Hashimoto | |

* cited by examiner 10
20
54
50
LOAD
L
R
$I_{LOAD}$
$M_{HS}$
32
OUT
$M_{LS2}$
36
$M_{LS1}$
40
VDD
28
24
$V_{ZENER}$
On/Off
48
$T_{MHS}$
34
38
44
+
-
$T_{protection}$

TEMPERATURE-BASED CONTROL OF INDUCTOR DEMAGNETIZATION

CROSS-REFERENCE TO RELATED APPLICATIONS

This application is a continuation of U.S. application Ser. No. 14/184,866 (now U.S. Pat. No. 9,673,007), filed on Feb. 20, 2014, which claims the benefit of U.S. Provisional Application No. 61/880,446, filed on Sep. 20, 2013. The entire disclosures of the applications referenced above are incorporated herein by reference.

FIELD

The present disclosure relates to circuits for discharging energy from an inductor.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

One application of an industrial high-side switch is to drive a coil (or inductor) of an electromagnetic relay. During an "ON" phase, the high-side switch delivers current to the coil. The coil generates magnetic force to keep contacts of the electromagnetic relay closed. When the electromagnetic relay is opened, it is desirable to transition the coil current to zero as fast as possible in order to preserve the electromagnetic relay (referred to herein as "fast demagnetization").

Fast demagnetization may be accomplished by making the switch behave as a high-voltage Zener diode, which clamps a voltage of the coil at about $V_{Zener}$=50V below $V_{DD}$. For example with a power supply voltage $V_{DD}$=30V, the inductance of the coil will see a reverse voltage of $V_{DD}-V_{Zener}$=−20V, which will drive the inductance demagnetization.

During fast demagnetization, an integrated circuit (IC) will generate thermal power ($P=V_{Zener}*I_{inductor}$) that can become very high when large relays are used (e.g. P=50 W). As a consequence, the IC will heat up quickly. Unfortunately, the coil current cannot be stopped while it is flowing. Therefore, the high-side switch needs to rely solely upon the power dissipation capability of the IC package to maintain the temperature of the IC until the coil is completely discharged. Above a certain energy level (depending on the size of the electromagnetic relay and on the initial current), the high-side switch eventually fails and is permanently damaged.

SUMMARY

An integrated circuit for demagnetizing an inductive load includes a switch to control current supplied by a voltage supply to the inductive load. A Zener diode includes an anode connected to a control terminal of the switch and a cathode connected to the voltage supply. A first transistor includes a control terminal and first and second terminals. The first terminal of the first transistor is connected to the inductive load. A second transistor includes a control terminal and first and second terminals. The first terminal of the second transistor is connected to the second terminal of the first transistor. A temperature sensing circuit is configured to sense a temperature of the switch and to generate a sensed temperature. A comparing circuit includes inputs that receive a reference temperature and the sensed temperature and an output connected to the control terminals of the first and second transistors.

In other features, the switch comprises first and second terminals. The first terminal is connected to the voltage supply and the second terminal is connected to the inductive load.

In other features, the switch comprises a double-diffused metal oxide semiconductor (DMOS) field effect transistor (FET). The first and second transistors comprise DMOS FETs.

In other features, the first and second transistors have an on-resistance value that is higher than an on-resistance value of the switch.

In other features, the comparing circuit turns on the first and second transistors when the sensed temperature is greater than the reference temperature and turns off the first and second transistors when the sensed temperature falls below the reference temperature. The comparing circuit turns on the first and second transistors when the sensed temperature is greater than the reference temperature and turns off the first and second transistors when the sensed temperature falls below the reference temperature by a predetermined amount.

In other features, when the switch is turned off, current from the load is dissipated by the integrated circuit at a first rate until the sensed temperature reaches the reference temperature. The integrated circuit dissipates current at a second rate that is slower than the first rate when the sensed temperature is greater than the reference temperature.

In other features, the integrated circuit dissipates current at the second rate until the sensed temperature falls below the reference temperature by a predetermined amount. The integrated circuit dissipates current at the first rate after the sensed temperature falls below the reference temperature by the predetermined amount.

In still other features, the switch comprises a transistor including a body to epitaxial diode. The first and second transistors include body to epitaxial diodes. The inductive load includes an inductor.

A method for demagnetizing an inductive load includes controlling current supplied by a voltage supply to an inductive load using a switch; connecting a Zener diode to a control terminal of the switch and to the voltage supply; sensing a temperature of the switch and generating a sensed temperature; and selectively connecting first and second transistors to the inductive load when the switch is open to slow a demagnetization rate of the inductive load based on the sensed temperature and a reference temperature.

In other features, the switch comprises a double-diffused metal oxide semiconductor (DMOS) field effect transistor (FET) and the first and second transistors comprise DMOS FETs. The first and second transistors have an on-resistance value that is higher than an on-resistance value of the switch.

In other features, the method includes turning on the first and second transistors when the switch is open and the sensed temperature is greater than the reference temperature; and turning off the first and second transistors when the switch is open and the sensed temperature falls below the reference temperature.

In other features, the method includes turning on the first and second transistors when the switch is open and the sensed temperature is greater than the reference temperature;

and turning off the first and second transistors when the switch is open and the sensed temperature falls below the reference temperature by a predetermined amount.

In other features, when the switch is open, the method includes dissipating current from the inductive load at a first rate until the sensed temperature is greater than the reference temperature; and dissipating current from the inductive load at a second rate that is slower than the first rate when the sensed temperature is greater than the reference temperature.

In other features, when the switch is open, the method includes dissipating current at the second rate until the sensed temperature falls below the reference temperature by a predetermined amount; and dissipating current at the first rate after the sensed temperature falls below the reference temperature by the predetermined amount.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The present disclosure relates to systems and methods for safely demagnetizing an inductor or coil to protect an integrated circuit (IC) during demagnetization. The demagnetization can be performed without damage independent of an amount of energy to be dissipated. The systems and methods according to the present disclosure allow the use of relays of any size and allow the IC to be mounted in smaller packages.

As will be described further below, the circuit monitors temperature and performs in a typical manner until a predetermined temperature is exceeded. When the predetermined temperature is exceeded, the circuit provides protection at the expense of reduced performance. The performance reduction will have a negligible negative impact for most applications.

Controlled demagnetization is accomplished by automatically selecting a fast or slow demagnetization mode. During the fast demagnetization mode, the circuit behaves in a typical fashion. For example, the circuit may clamp the coil or inductor voltage to about 50V below $V_{DD}$. During the fast demagnetization mode, the temperature will rise at a fast pace. Once the predetermined temperature is reached, the circuit switches to the slow demagnetization mode and will reduce power dissipation to a level that can be sustained indefinitely. During the slow demagnetization mode, the coil or inductor discharges at a slower rate and the IC temperature will decrease. Once the temperature has fallen back to an acceptable value, the fast demagnetization mode is initiated again. The circuit switches between the fast and slow demagnetization modes until the coil or inductor is completely discharged.

Figure 1:
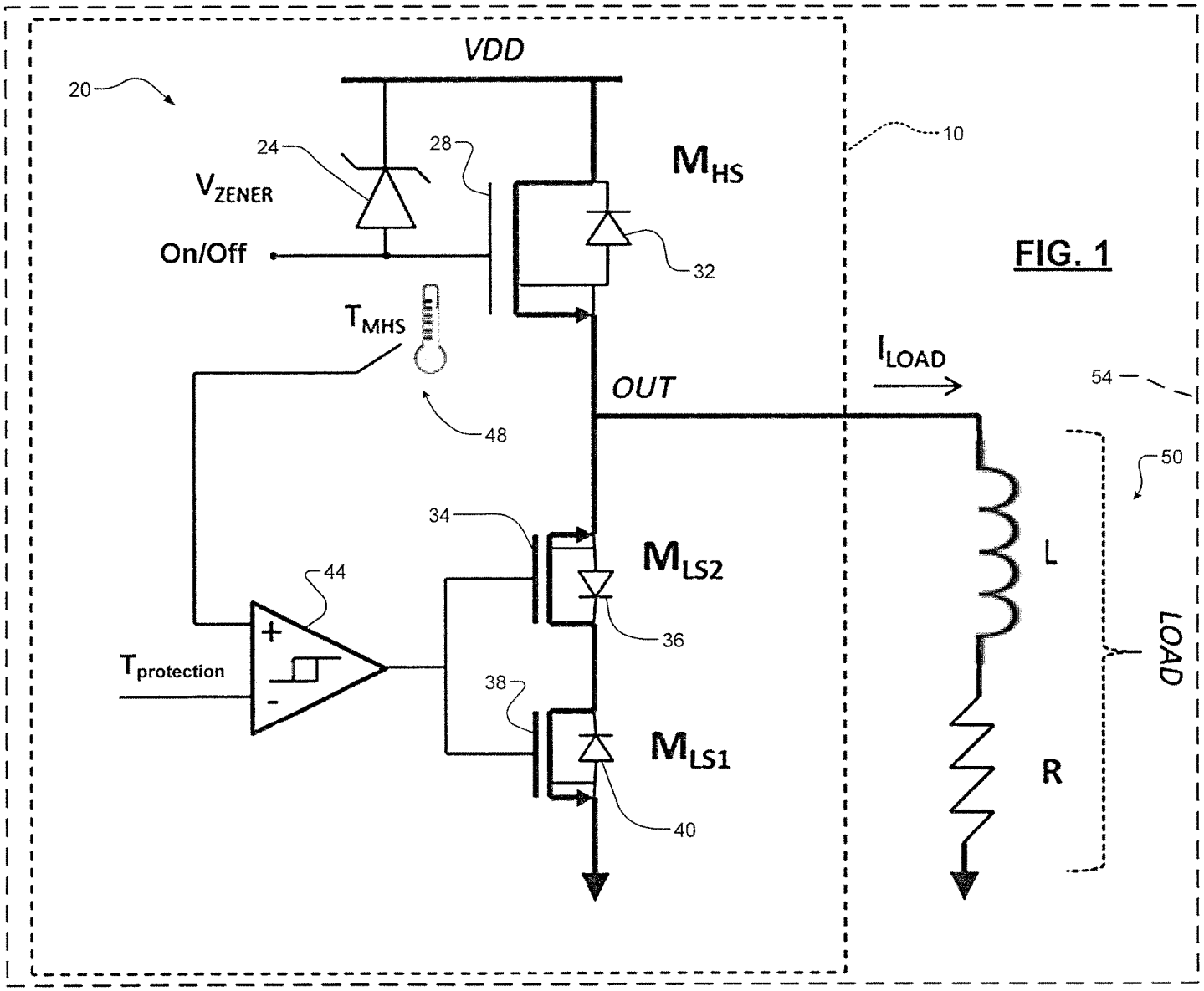
FIG. 1 is an electrical schematic and functional block diagram of an integrated circuit including a high-side switch according to the present disclosure.

FIG. 1 illustrates an integrated circuit (IC) 10 including a circuit 20. The circuit 20 includes a high-side switch 28 having a first terminal connected to $V_{DD}$, a second terminal connected to an output and a gate connected to a Zener diode 24. The high-side switch 28 includes a body to epitaxial (EPI) diode 32. A transistor 34 includes a first terminal connected to the output and a body to epitaxial (EPI) diode 36. A second terminal of the transistor 34 is connected to a first terminal of a transistor 38. A second terminal of the transistor 38 is connected to a reference potential such as ground. The transistor 38 includes a body to epitaxial (EPI) diode 40.

Gates of the first and second transistors 34 and 38 are connected to an output of a comparing circuit 44. The comparing circuit 44 may employ hysteresis. An inverting input of the comparing circuit 44 is connected to a first temperature reference $T_{protection}$. A non-inverting input of the comparing circuit 44 is connected to a temperature sensor 48 that senses a temperature of the high-side switch 28.

A load 50 is connected to the output of the circuit 20. The load 50 may include an inductor L and a resistor R that are connected in series, although other types of loads or connections may be used.

The high-side switch 28 drives the load 50. The high-side switch 28 is made by a low-on-resistance, high-voltage transistor such as a $R_{ON}$=0.05Ω, 65V double-diffused metal—oxide—semiconductor (DMOS) field effect transistors (FET). The maximum current $I_{LOAD}$ that has to be sourced is 1A. The Zener diode 24 is placed between $V_{DD}$ and a gate of the high-side switch 28 to implement the fast demagnetization mode. After the high-side switch 28 is turned off and the output is pulled negative by current of the inductor L, the Zener diode 24 turns on the high-side switch 28 and maintains $V_{OUT}=V_{DD}-V_{ZENER}-V_{GS}$. $V_{GS}$ is the gate-source voltage of the high-side switch 28 needed to sustain $I_{LOAD}$; since the high-side switch 28 is relatively large, $V_{GS}$ is in the order of 1V in some examples. In some examples, $V_{DD}$=24V, $V_{ZENER}$=50V, $V_{GS}$=1V→$V_{out_demag}$=−27V.

Transistors 34 and 38 may be implemented using DMOS FETs with smaller area than the high-side switch (and therefore higher on-resistance). In some examples, $R_{ON}$ of the transistors 34 and 38 is 0.5Ω. The transistors 34 and 38 are normally kept in an off state ($V_{GS}$=0V) and do not conduct current for either positive or negative values of $V_{OUT}$ due to opposite body-to-EPI diodes 36 and 40. The transistor 34 can be a p-channel transistor and the transistor 38 can be an n-channel transistor.

Figure 2:
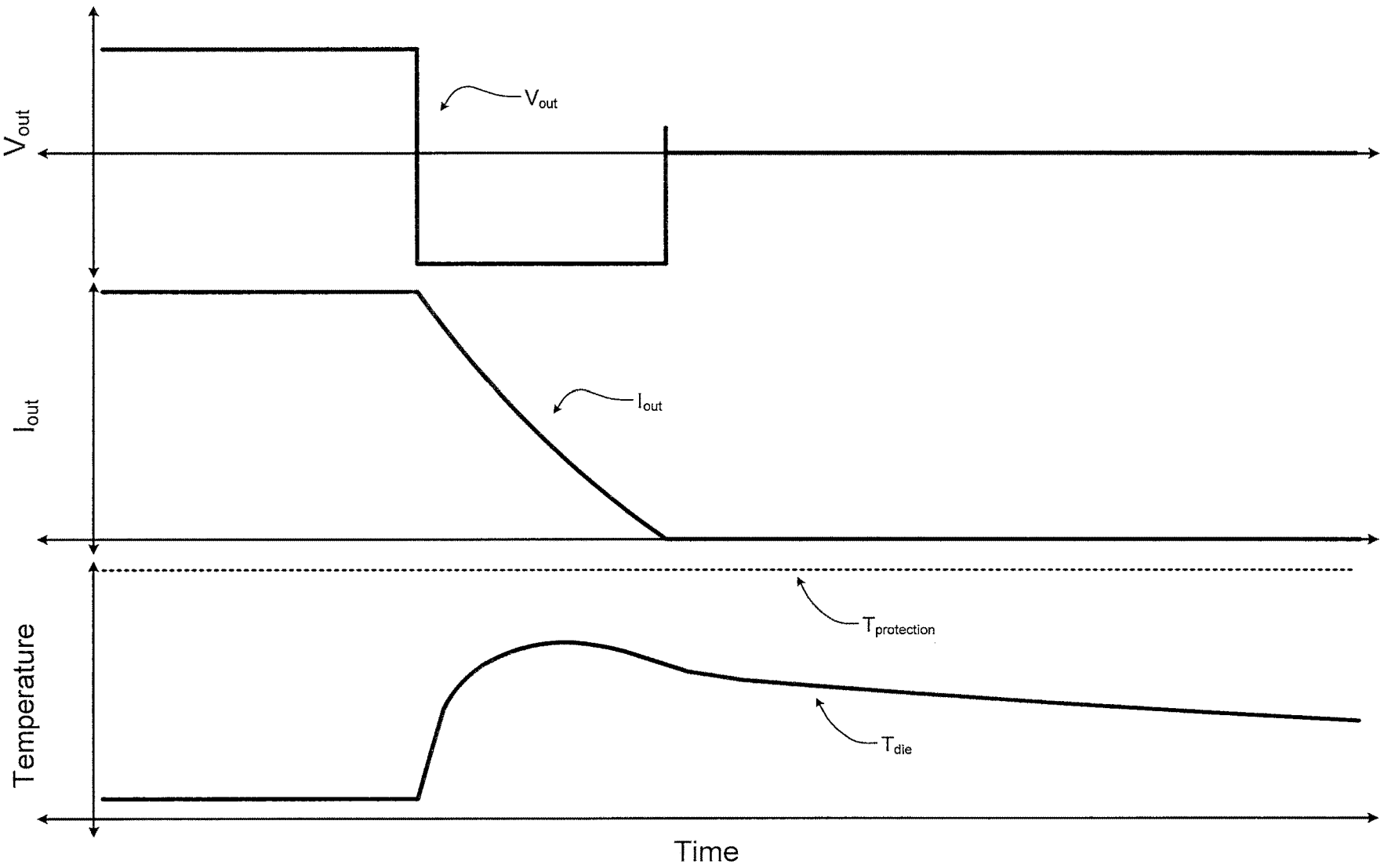
FIGS. 2 and 3 include graphs illustrating temperature, current and voltage as a function of time.

FIG. 2 shows a simulation of sample demagnetization curves of the high-side switch 28 during the fast demagnetization mode. The simulation in FIG. 2 was run with a thermal model for a quad-flat no-leads (QFN) package. The high-side switch 28 acts as a 50V clamp from $V_{DD}$. IC temperature never reaches the $T_{protection}$ threshold. The temperature of the high-side switch 28 ($T_{MHS}$) is monitored and, $T_{MHS}$ stays below $T_{protection}$ (which may be set to about 170° C. or another value in some examples).

Depending on the values of L, R and $I_{LOAD}$ and on package thermal dissipation properties, the temperature $T_{MHS}$ may exceed $T_{protection}$ during the fast demagnetization mode. Conventional high-side switches are unable to limit the temperature $T_{MHS}$ because the inductor current $I_{LOAD}$ cannot be limited. Therefore the high-side switch 28 would keep working as a 50V clamp device and would continue to dissipate high power and heat up. At some point, the circuit 20 may be permanently damaged.

According to the present disclosure, when the temperature $T_{MHS}$ reaches $T_{protection}$, the slow demagnetization mode is initiated and both of the transistors 34 and 38 are turned on. $I_{LOAD}$ will start flowing through the transistors 34 and 38 instead of the high-side switch 28 and $V_{OUT}$ will increase from −27V to about −1V. The high-side switch 28 will stop dissipating power and the transistors 34 and 38 will start dissipating power (about 1/50 of the power dissipated by the high-side switch 28). The amount of power that is dissipated by the transistors 34 and 38 is small enough to be sustained indefinitely with the given package.

As a result, the inductor current will now decrease at slower rate and the IC will cool down. Once the temperature $T_{MHS}$ falls below $T_{protection}-T_{hysteresis}$, the transistors 34 and 38 will turn OFF. At this point, the high-side switch 28 will automatically be turned ON again by $V_{OUT}$ being pulled negative by the residual inductor current. The process will repeat until $I_{LOAD}$ disappears.

Figure 3:
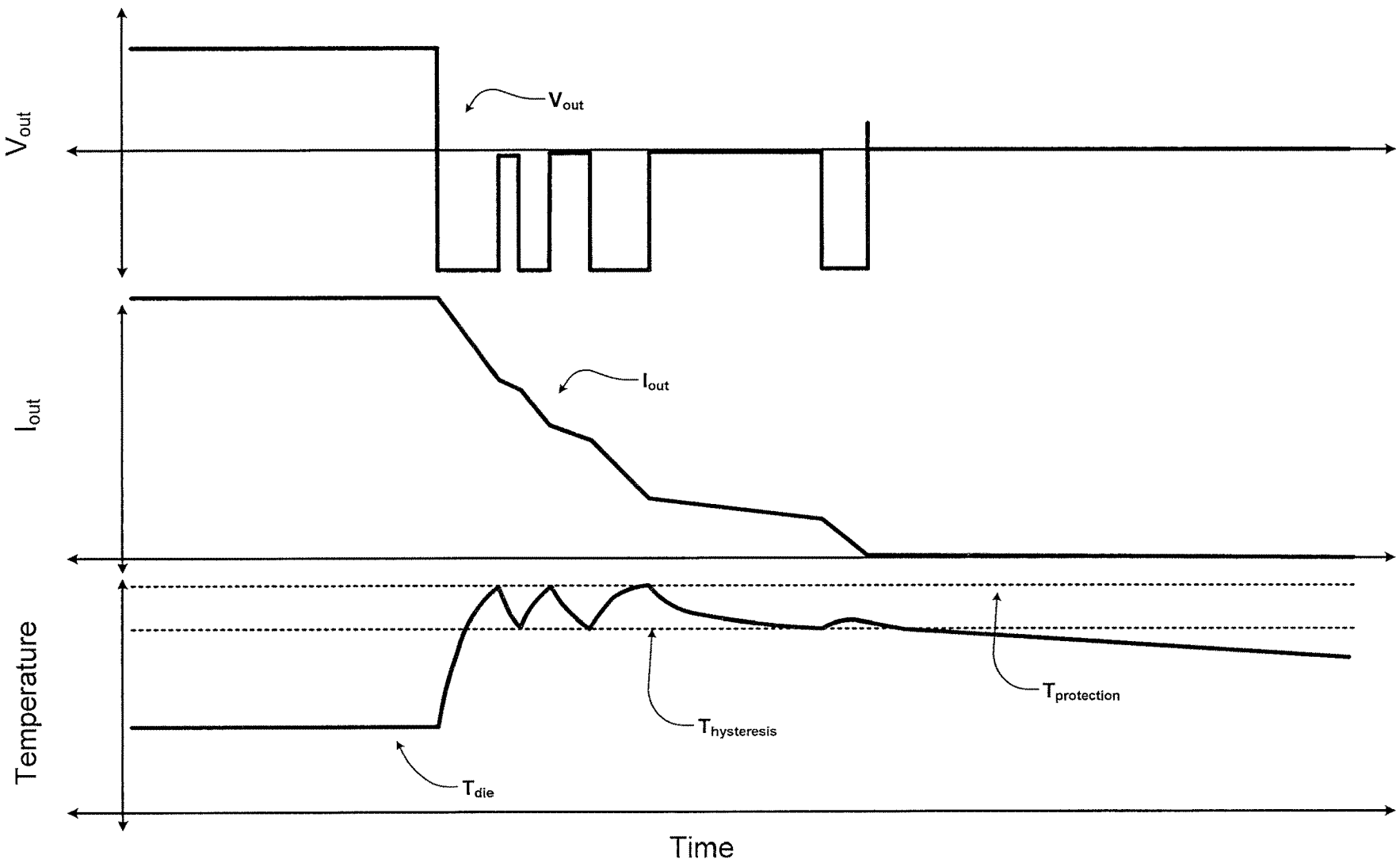

FIG. 3 shows an example of the slow demagnetization mode according to the present disclosure. The simulation in FIG. 3 was also run with a thermal model for the QFN package. Starting from a higher ambient temperature (e.g. 85° C. in this example) than in FIG. 2, the IC temperature reaches the $T_{protection}$ threshold. At that point, the slow demagnetization mode stops the temperature rise and protects the circuit 20.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

What is claimed is:

1. A discharge circuit for an inductive load, comprising:

a clamp circuit connected between a first reference potential and an output node, wherein the inductive load is connected to the output node;

a temperature sensing circuit to generate a sensed temperature signal based on a temperature of the clamp circuit; and a first circuit including:

a first switch connected between the output node and a second reference potential; and a comparing circuit to selectively open and close the first switch based on the sensed temperature signal;

wherein the comparing circuit turns on the first switch when the sensed temperature signal is greater than a reference temperature signal by a predetermined amount to cause power to be dissipated from the inductive load by the first switch at a first rate and turns off the first switch when the sensed temperature signal falls below the reference temperature signal by the predetermined amount;

wherein the first switch dissipates power at the first rate until the sensed temperature signal falls below the reference temperature signal by the predetermined amount; and wherein the clamp circuit dissipates power at a second rate greater than the first rate after the sensed temperature signal falls below the reference temperature signal by the predetermined amount.

2. The discharge circuit of claim 1, wherein the clamp circuit includes:

a second switch having a first terminal connected to the first reference potential and a second terminal connected to the output node; and a Zener diode having an anode connected to the output node and a cathode connected to the first reference potential.

3. The discharge circuit of claim 2, wherein:

the first switch comprises first and second transistors including (DMOS) field effect transistor (FETs); and the second switch comprises a double-diffused metal oxide semiconductor DMOS FET.

4. The discharge circuit of claim 2, wherein:

the first switch includes first and second transistors including body to epitaxial diodes; and the second switch comprises a transistor including a body to epitaxial diode.

5. The discharge circuit of claim 1, wherein the discharge circuit is implemented as an integrated circuit.

6. A discharge circuit comprising:

a first circuit including a first switch and a Zener diode, wherein the first circuit is connected to a first reference potential;

a second switch connected to the first circuit and a second reference potential;

an inductive load having a first terminal connected to the first circuit and the second switch and a second terminal connected to the second reference potential; and a second circuit to:

turn off the second switch when a sensed temperature signal corresponding to the first circuit is less than a reference temperature signal to cause power to be dissipated from the inductive load by the first circuit at a first rate; and in response to the sensed temperature signal of the first circuit being greater than or equal to the reference temperature signal, turn on the second switch to cause power to be dissipated from the inductive load by the second switch at a second rate that is less than the first rate;

wherein the second switch dissipates current at the second rate until the sensed temperature signal falls below the reference temperature signal by a predetermined amount; and wherein the first switch dissipates current at the first rate after the sensed temperature signal falls below the reference temperature signal by the predetermined amount.

7. The discharge circuit of claim 6, wherein:

the first switch comprises a double-diffused metal oxide semiconductor (DMOS) field effect transistor (FET); and the second switch comprises first and second transistors including DMOS FETs.

8. The discharge circuit of claim 6, wherein the second circuit comprises a comparing circuit.

9. The discharge circuit of claim 6, wherein:

the first switch comprises a transistor including a body to epitaxial diode; and the second switch includes first and second transistors including body to epitaxial diodes.

10. The discharge circuit of claim 6, wherein the discharge circuit is implemented as an integrated circuit.

* * * * *